US010480877B1

(12) United States Patent
Myers

(10) Patent No.: US 10,480,877 B1
(45) Date of Patent: Nov. 19, 2019

(54) DETACHABLE BOX MAGAZINE WITH FOLLOWER RETRACTION MEMBER

(71) Applicant: Kent J. Myers, Magnolia, OH (US)

(72) Inventor: Kent J. Myers, Magnolia, OH (US)

( * ) Notice: Subject to any disclaimer, the term of this patent is extended or adjusted under 35 U.S.C. 154(b) by 0 days.

(21) Appl. No.: 15/953,824

(22) Filed: Apr. 16, 2018

Related U.S. Application Data

(63) Continuation-in-part of application No. 15/784,785, filed on Oct. 16, 2017, now Pat. No. 10,234,220.

(60) Provisional application No. 62/485,561, filed on Apr. 14, 2017.

(51) Int. Cl.
*F41A 9/67* (2006.01)
*F41A 9/83* (2006.01)

(52) U.S. Cl.
CPC .. *F41A 9/67* (2013.01); *F41A 9/83* (2013.01)

(58) Field of Classification Search
CPC ..... F41A 9/66; F41A 9/67; F41A 9/70; F41A 9/84
USPC ..... 42/1.02
See application file for complete search history.

(56) References Cited

U.S. PATENT DOCUMENTS 1,867,513 A * 7/1932 Lahti ..... F41A 9/73 124/45
4,831,761 A 5/1989 Kulakow
5,799,432 A * 9/1998 Wright, Sr. ..... F41A 9/62 42/1.02
8,468,730 B2 6/2013 Faifer et al.
9,010,005 B2 4/2015 Faifer
9,022,015 B2 * 5/2015 Tseng ..... F41A 9/70 124/51.1
9,103,614 B2 8/2015 Froehle et al.
9,182,185 B2 11/2015 Hatch
9,303,934 B1 4/2016 Kazsuk
2005/0030987 A1 2/2005 Nagai et al.
2005/0150148 A1 7/2005 Herpel
2011/0167695 A1 * 7/2011 Faifer ..... F41A 9/67 42/50
2014/0373421 A1 12/2014 Hatch
2016/0169602 A1 * 6/2016 Demierre ..... F41A 9/70 42/1.02

* cited by examiner

*Primary Examiner* — Stephen Johnson

(74) *Attorney, Agent, or Firm* — Renner Kenner Greive Bobak Taylor & Weber

(57) ABSTRACT

A detachable box magazine includes a housing having a base; a follower; a biasing element biasing the follower away from the base; a spool member; a retraction member operatively connected to the follower and to the spool member; a winding member selectively engaged with the spool member, and, when engaged with the spool member, manipulated to rotate the spool member in a winding direction to wind the retraction member about the spool member and pull the follower toward the base against the biasing element.

4 Claims, 15 Drawing Sheets

DETACHABLE BOX MAGAZINE WITH FOLLOWER RETRACTION MEMBER

CROSS-REFERENCE TO RELATED APPLICATIONS

The present application is a Continuation in Part of U.S. Ser. No. 15/784,785, filed Oct. 16, 2017, which claims the benefit of U.S. Provisional Application 62/485,561, filed Apr. 14, 2017, now U.S. Pat. No. 10,234,220, both of which are incorporated herein by reference.

FIELD OF THE INVENTION

The present invention generally relates to detachable box magazines. In particular, the present invention relates to detachable box magazines having a retraction member for retracting the follower to allow for the loading of cartridges.

BACKGROUND OF THE INVENTION

The manual loading of cartridges into a detachable box magazine can be difficult under normal circumstances, even for individuals with average dexterity and strength. To loading a magazine, one must press a cartridge against a spring-biased follower or a cartridge/stack of cartridges already loaded, and, each successive cartridge that is loaded requires more force. Due to the initial strength of the spring, it can be difficult for most people to fully load a brand new magazine of moderate size, and the loading of cartridges even in older magazines where the spring has weakened can be particularly difficult for those with less strength and/or less dexterity or for those in inclement weather—it is hard to load cartridges with cold and/or numb hands or with shooting gloves.

Additionally, the improper loading of cartridges—for example, when one accidently presses a cartridge against the shoulders of the magazine instead of the follower or top-most cartridge—can lead to a compromising of the structure of the detachable box magazine resulting in the need for early replacement. As a result, attempts have been made to facilitate the loading of cartridges into detachable box magazines. Notably, prior art attempts have not been well received, as there currently appears to be no such product in the marketplace. Those products shown in prior patents/patent applications are simply inadequate for the job.

For example, U.S. Pat. No. 9,303,934, proposes using a rod operatively attached to the follower, the rod having a grip that can be grasped by the user to pull the rod and hence the follower downward in the housing of the detachable box magazine. This requires a secure attachment between the rod and a plate that interacts with the follower, and this attachment is achieved by screwing the rod into threads in the plate. When fully loaded, a long rod extends out of the bottom of the magazine, which is highly undesirable, so it must be screwed out from engagement with the plate, and then stored or placed aside for further use. Notably the threading and unthreading of the rod is not so easy. For a tall magazine it is not easy to align threads on the end of a rod with threads in a plate held at the distal end of the magazine and then rotate the rod and engage the threads. This device also requires pulling the rod against the biasing member, requiring user strength rather than employing an mechanical advantage.

U.S. Pat. No. 8,468,730 discloses a device having elements extending out beyond the bottom of the magazine housing in an undesirable manner. A wheel extends from the base of the housing and is rolled against a surface to wind a wire about an axle of the wheel, the wire being attached to the follower such that the follower is retracted in the housing as the wheel is rotated. In addition to having undesirable elements extending beyond the typical base of a detachable box magazine, this system would undesirably allow the introduction of debris into the housing, inasmuch as the wheel must extend out of the housing with portions thereof contacting dirty surfaces and the like during use. As the wheel is rotated, the debris the wheel encounters is ultimately brought into the interior of the housing as the wheel rotates. Additionally, this system is simply not user friendly, requiring suitable friction between the wheel and the surface with which it is engaged to roll the wheel and wind the wire. Finally, the ratchet mechanism it employs, while being practical, is unnecessarily complicated, to the extent that it can even be fully understood from the disclosure provided. As best understood, it appears the ratchet will release when the wheel is lifted from the surface it is engaged with during winding. Thus it appears one must maintain forceful contact between the wheel and the surface in order to load a cartridge. If one winds the follower downward and then lifts the wheel off of the surface while reaching for cartridges to load, the follower will forcefully return to the shoulders (or to seat the already-loaded cartridges), and one must repeat the winding procedure.

U.S. Pat. No. 9,022,015 discloses a device for loading a magazine for an air gun, and provides only disclosure of how the magazine could be loaded. There is no disclosure of how it functions and particularly how a pawl and ratchet system thereof is released to allow unloading of the magazine by firing of, presumably, round shots or BBs. Though pulling of a support (follower) is achieved by turning a knob that turns a pulley, the structures employed are unnecessarily complicated and function differently from the present invention. The knob is turned by the flat of the thumb, through friction, and there is no releasing of the pulley from the knob. Indeed, there is no disclosure of how the pulley is released to unload the magazine, and such functioning is not clear if at all discernable.

The present inventor has recognized the need in the art for an improved retraction mechanism for a detachable box magazine—one that is practical in all regards as to function and safety and ease of manufacture and use, and thus practical for actual commercial production to serve the large number of individuals that desire an easier way to load cartridges.

SUMMARY OF THE INVENTION

In a first embodiment, the present invention provides a detachable box magazine comprising: a housing having a base; a follower; a biasing element biasing said follower away from said base; a spool member; a retraction member operatively connected to said follower and to said spool member; a winding member selectively engaged with said spool member, and, when engaged with said spool member, manipulated to rotate said spool member in a winding direction to wind said retraction member about said spool member and pull the follower toward said base against said biasing element.

In a second embodiment, the present invention provides a detachable box magazine as in any of the embodiments above, wherein said winding member is a hand-driven winding member.

In a third embodiment, the present invention provides a detachable box magazine as in any of the embodiments above, further comprising a force-distributing member secured proximate to first and second distal ends of the follower, said first distal end being the end of the follower near the primer end of a loaded cartridge, and said second distal end being the end of the follower near the bullet end of a loaded cartridge In a fourth embodiment, the present invention provides a detachable box magazine as in any of the embodiments above, wherein, when said hand-driven winding member is engaged with said spool member, said spool member is prevented from rotating in an unwinding direction that would permit said retraction member to unwind from said spool member under the bias of the biasing element.

In a fifth embodiment, the present invention provides a detachable box magazine as in any of the embodiments above, wherein disengaging said winding member from engagement with said spool member permits said spool member to rotate in said unwinding direction under the bias of said biasing element to permit said retraction member to unwind from said spool member In a sixth embodiment, the present invention provides a detachable box magazine as in any of the embodiments above, further comprising a locking member preventing rotation of said spool member in said unwinding direction when said winding member is engage with said spool member.

In a seventh embodiment, the present invention provides a detachable box magazine as in any of the embodiments above, further comprising a drive nut, said winding member having a drive shaft extending through said spool member and engaging said drive nut.

In an eighth embodiment, the present invention provides a detachable box magazine as in any of the embodiments above, wherein said drive nut is held by said locking member to allow rotation of said drive nut in a winding direction and prevent rotation of said drive nut in an unwinding direction, said locking member permitting axial movement of said drive nut toward and away from said spool member In a ninth embodiment, the present invention provides a detachable box magazine as in any of the embodiments above, wherein said winding member has a spool-engaged position, wherein said spool member is pinched between said winding member and said drive nut and manipulation of said winding member rotates said spool member in said winding direction, and a release position, wherein said spool member is not pinched between said winding member and said drive nut such that said spool member is permitted to rotate in said unwinding direction under the bias of said biasing element to permit said retraction member to unwind from said spool member.

In a tenth embodiment, the present invention provides a detachable box magazine as in any of the embodiments above, wherein a portion of said drive shaft is threaded and fits into a threaded bore in said drive nut In an eleventh embodiment, the present invention provides a detachable box magazine as in any of the embodiments above, wherein said locking member is a pawl, and said drive nut includes a gear interacting with said pawl to form a ratchet mechanism.

In a twelfth embodiment, the present invention provides a detachable box magazine as in any of the embodiments above, further comprising a cap and a spring, wherein said drive shaft extends through said drive nut and said locking member, wherein said cap is provided on said drive shaft, and said spring urges the cap in a direction that pulls said winding member in the direction defined from said locking member to said cap In a thirteenth embodiment, the present invention provides a detachable box magazine as in any of the embodiments above, wherein said locking member is fixed in place in said base.

In a fourteenth embodiment, the present invention provides a detachable box magazine as in any of the embodiments above, wherein said locking member is a one-way bearing.

In a fifteenth embodiment, the present invention provides a detachable box magazine as in any of the embodiments above, further comprising a cap and a spring, wherein said drive shaft extends through said drive nut and said locking member, wherein said cap is provided on said drive shaft, and said spring urges the cap in a direction that urges said winding member toward said locking member.

In a sixteenth embodiment, the present invention provides a detachable box magazine as in any of the embodiments above, wherein said locking member is fixed in place in said base.

In a seventeenth embodiment, the present invention provides a detachable box magazine as in any of the embodiments above, wherein surfaces of any one of said spool member, said winding member, and said drive nut are cut or shaped so as to increase friction between such surfaces in the pinching occurring in the spool-engaged position.

In an eighteenth embodiment, the present invention provides a detachable box magazine as in any of the embodiments above, wherein said winding member interacts with said locking member when said winding member is engaged with said spool member.

In a nineteenth embodiment, the present invention provides a detachable box magazine as in any of the embodiments above, wherein said locking member prevents rotation of said winding member in an unwinding direction.

In a twentieth embodiment, the present invention provides a detachable box magazine as in any of the embodiments above, wherein said locking member is a one-way bearing.

In a twenty-first embodiment, the present invention provides a detachable box magazine as in any of the embodiments above, wherein said winding member includes a drive shaft interacting with said one-way bearing.

In a twenty-second embodiment, the present invention provides a detachable box magazine as in any of the embodiments above, wherein said drive shaft extends through a through bore in said one-way bearing when said winding member is selectively engaged with said spool member.

In a twenty-third embodiment, the present invention provides a detachable box magazine as in any of the embodiments above, wherein said winding member is removable from engagement with the remainder of said box magazine so as to be capable of being carried around.

In a twenty-fourth embodiment, the present invention provides a detachable box magazine as in any of the embodiments above, further comprising a storage bore, wherein said winding member is storable in said storage bore.

In a twenty-fifth embodiment, the present invention provides a detachable box magazine as in any of the embodiments above, wherein said locking member is a pawl, and said winding member includes a drive shaft interacting with said pawl to form a ratchet mechanism.

In a twenty-sixth embodiment, the present invention provides a detachable box magazine as in any of the embodiments above, wherein said winding member includes a first coupling member and said spool member includes a second coupling member, and said winding member is selectively engaged with said spool member by mating said first coupling member with said second coupling member.

In a twenty-seventh embodiment, the present invention provides a detachable box magazine as in any of the embodiments above, wherein said first coupling member is a male member and said second coupling member is a female member or said first coupling mechanism is a female member and said second coupling member is a male member.

In a twenty-eighth embodiment, the present invention provides a detachable box magazine as in any of the embodiments above, wherein said first coupling member is formed at a distal end of said drive shaft, and said second coupling member is formed in at a distal end of said spool member.

In a twenty-ninth embodiment, the present invention provides a detachable box magazine as in any of the embodiments above, wherein said winding member has a spool-engaged position, wherein said first and second coupling members are mated and manipulation of said winding member rotates said spool member in said winding direction, and a release position, wherein said first and second coupling members are uncoupled and said spool member is permitted to rotate in said unwinding direction under the bias of said biasing element to permit said retraction member to unwind from said spool member.

DETAILED DESCRIPTION OF ILLUSTRATIVE EMBODIMENTS

Multiple embodiments are disclosed. It will be appreciated by those of ordinary skill in the relevant arts that many aspects of one embodiment might be implemented in another. Thus, while effort is made to give examples of this, the failure to specifically disclose a given combination of elements, should not be held to limit the invention.

Figure 1:
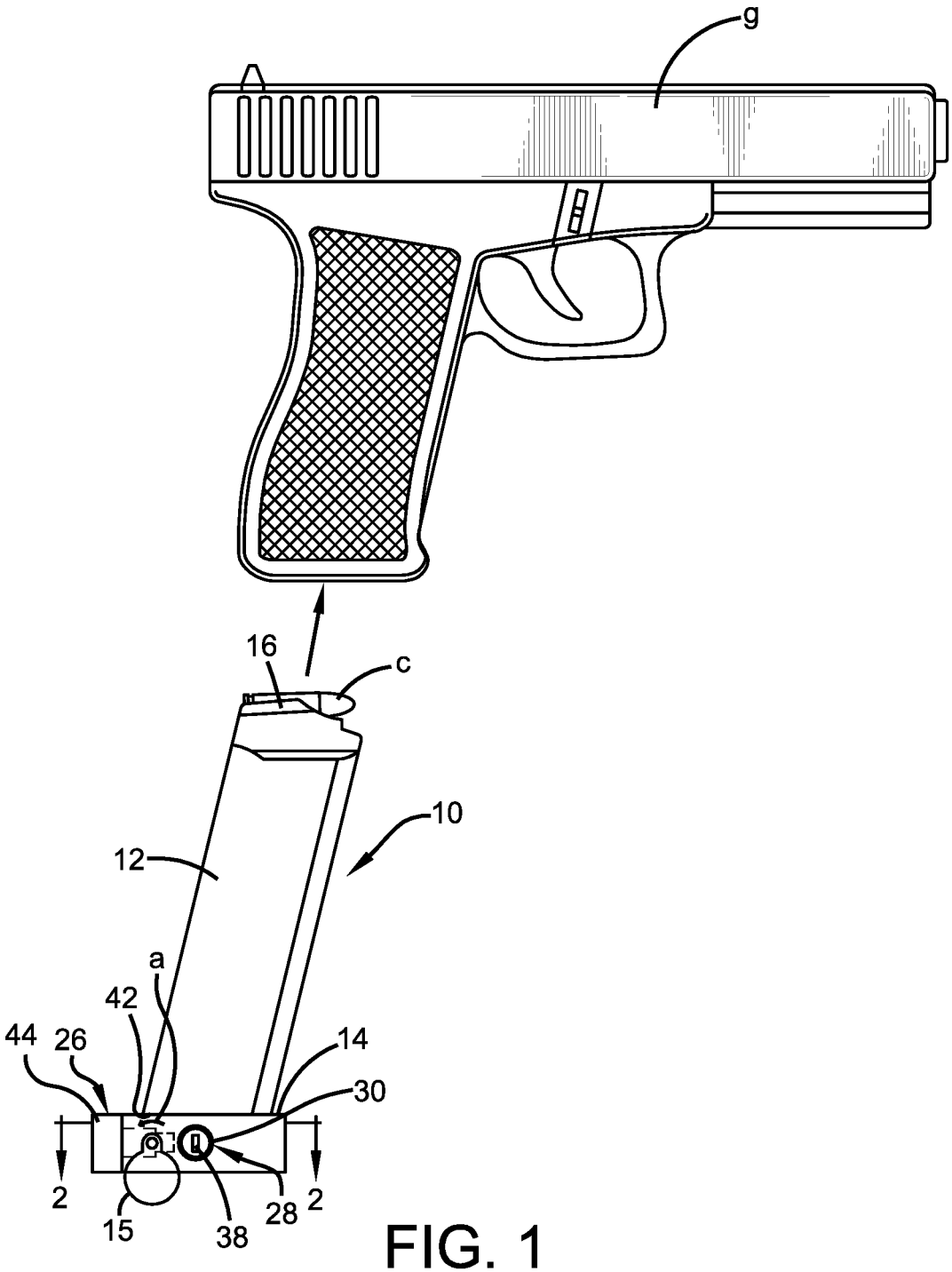
FIG. 1 is a side elevational view showing a gun g and a detachable box magazine in accordance with an embodiment of this invention.
Figure 2:
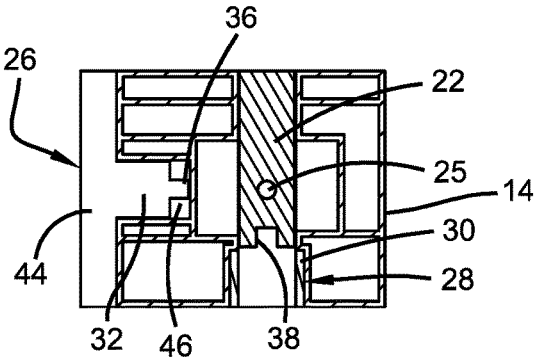
FIG. 2 is a cross-section taken along the line 2-2.

With reference to FIG. 1, a handgun g is shown with a detachable box magazine 10 of this invention removed from the handgun g and holding cartridges c therein. Although a handgun is shown, the present invention relates to any detachable box magazine, for any type of gun. The concepts disclosed herein are shown as applied to a box magazine wherein the cartridges are loaded in a single column, but can readily be applied to box magazines where cartridges are loaded in a staggered formation (i.e., double-stack formation) or even casket magazines (quad-column). Although a handgun is shown, the invention certainly applies to any magazine for a rifle or any other implement in which a magazine-style loading is employed.

Referring to FIGS. 1-6, the detachable box magazine 10 of the present invention has a housing 12, a base 14 opposite shoulders 16, and a follower 18 that is biased by a biasing element 20 acting between the base 14 and the follower 18 to urge the follower 18 up towards the shoulders 16. The base 14 mentioned here is simply the bottom portion of the housing, and various elements of this invention that fit within the base 14 are part of the present invention and not part of the common elements of a box magazine. The base is a logical location for these elements, but they could be positioned elsewhere. The present invention improves the art and provides useful functionality by adding a spool member 22 for retracting the follower 18 away from the shoulders 16 to permit the loading of one or more cartridges c. Whereas a user would typically press a cartridge c against the follower 18 to overcome the force of the biasing element 20, move the follower 18 down, and urge the cartridge c under the shoulders 16 and into a proper loaded position, the present invention instead employs the spool member 22 to retract the follower 18 and compress the biasing element 20 and provide the necessary space between the shoulders 16 and the follower 18 to allow for the loading of one or more cartridges c.

A retraction member 24 is operatively connected to the follower 18 and to the spool member 22. When unloaded (FIG. 5) or only partially loaded, rotation of the spool member 22 in a winding direction winds the retraction member 24 about the spool member 22, pulling the follower 18 downward. A winding member 26 can be selectively engaged with the spool member 22, as seen particularly in comparison of FIGS. 2 and 3. When engaged with the spool member 22, the winding member 26 can be manipulated to rotate the spool member 22 in a winding direction to wind the retraction member 24 about the spool member 22 and pull the follower 18 toward the base 14 against the biasing element 20. When disengaged, the winding member 26 no longer affects the spool member 22, and the biasing element 20 pushes on the follower 18, which pulls the retraction member 24 off of the spool member 22, thus rotating the spool member 22 in an unwinding direction.

The retraction member 24 can be fastened by any appropriate manner to the follower and the spool member 22. A hole 25 is shown in the spool member 22 for this purpose, and a wire-like retraction member 24 could be tied or otherwise secured at this hole. A similar hole and tie-off could be used at follower 18.

The biasing element 20 is shown as a compression spring but can be any suitable biasing element presently employed or hereinafter employed in the art of replaceable box magazines. The retraction member 24 is any suitable member for winding about the spool member 22. In some embodiments, the retraction member 24 is selected from a wire, a strap, a belt, a cord, a cable, or the like, suitably strong to act against the biasing element 20.

Notably, when the winding member 26 is engaged with the spool member 22, the spool member 22 is prevented from rotating in an unwinding direction that would permit the retraction member 24 to unwind from the spool member 22 under the biasing force of biasing element 20. Thus, the follower 18 is maintained proximate the position to which it is pulled by the winding of the retraction member 24 about the spool member 22 in the winding direction. Disengaging the winding member 26 from engagement with the spool member 22 permits the spool member 22 to rotate in the unwinding direction under the bias of the biasing element 20 to permit the retraction member 24 to unwind from the spool member 22 so that the follower 18 can be urged toward the shoulders 16, properly seating whatever cartridges c have been loaded. In some embodiments, disengaging the winding member 26 from the spool member 22 allows the spool member 22 to freewheel. Loading of the cartridges c is likely now self-evident but will be addressed more fully below.

In some embodiments, the box magazine 10 further includes a locking member 28 that prevents rotation of the spool member 22 in the unwinding direction when the winding member 26 is engaged with the spool member 22. In some embodiments, the winding member 26 is engaged with the locking member 28 when the winding member 26 interacts with the spool member 22. In the embodiment shown, the winding member 26 extends past the locking member 28 to engage the spool member 22 such that a portion of the winding member interacts with the locking member 28. In accordance with particular embodiments, it is the locking member 28 that prevents rotation of the winding member 26 in the unwinding direction. In some embodiments, the locking member 28 is secured to the base 14 to as to be held stationary therein.

In the particular embodiment shown in FIGS. 1-6, the locking member 28 is a one-way bearing (also generally known as a clutch bearing), which, as used herein, is to be understood as a bearing permitting rotation of a shaft therein in one direction, while prohibiting rotation of that shaft in an opposite direction. Various one-way bearings are known and their use will be evident to those of ordinary skill in the art. In some embodiments, the one-way bearing is a clutch needle bearing. In some embodiments, the one-way bearing acts directly on a drive shaft 32 of the winding member, allowing rotation of the drive shaft 32 in one direction (e.g. clockwise) and preventing rotation in an opposite direction (e.g. counter-clockwise).

In the embodiment of FIGS. 1-6, the locking member 28 is a one-way bearing, 30 and the winding member 26 includes a drive shaft 32 that extends through a through bore 34 in the one-way bearing 30. The one-way bearing 30 is accessed at a side wall of the base 14, and some embodiments can include a cover 15, which is shown as a pivotable plate (see arrow a), but could instead be a diaphragm or other structure suitable to prevent or at least substantially frustrate the ability for debris to be introduced to the interior of the box magazine 10. The one-way bearing 30 permits the drive shaft 32 to rotate in one direction (e.g., clockwise) which will serve as the winding direction, and will prevent rotation of the drive shaft 32 in an unwinding direction (e.g., counter clockwise). The winding member 26 includes a first coupling member 36 and the spool member 22 includes a second coupling member 38. The winding member 26 is selectively engaged with the spool member 22 by inserting drive shaft 32 through the through bore 34 to make the first coupling member 36 with the second coupling member 38. In the embodiment shown, the first coupling member 36 is a male member that mates with a similarly shaped female member, which serves as the second coupling member 38. The first and second coupling members must simply mate or otherwise interact in a manner that allows the rotation of the drive shaft to be transmitted to the spool member 22. In other embodiments, the first coupling member could be a female member, while the second coupling member is a male member. Other couplings could be employed. The coupling can be any suitable coupling, and here is shown as a rectangular protrusion fitting into a rectangular slot and acting much like a flat head screwdriver and flat head screw.

In the particular embodiment shown, the first coupling member 36 extends from a distal end face 40 of the drive shaft 32, and the second coupling member 38 is formed in a proximal end face 42 of the spool member 22 (the end proximate the locking member 28).

In some embodiments, a handle portion 44 of the winding member provides the lever arm advantage necessary to rotate the drive shaft 32 against the biasing force of the biasing element 20. A knob or other structure could be employed. The handle portion 44 is shown rotating in the direction of arrow b in FIG. 6 to wind the retraction member 24 around the spool member 22. Thus, in some embodiments, the winding member is specifically intended to be a "hand-driven" winding member, which is used herein to specifically indicate that the winding member is manipulated by the user's hand, and a "hand-driven" winding member is specifically intended for such manipulation. In particular embodiments, the winding member is manipulated by a common finger-and-thumb turning of a handle, where the thumb pushes or pulls on one lever arm extending from an axis of rotation in one direction, and one or more fingers pull or push on an opposing lever arm extending from the axis of rotation in another direction. This is similar to how one turns a key in a lock. It will be readily appreciated through the application of basic physics that the diameter of the spool member 22 and the lever arm of the handle portion 44 (or knob or other structure) can be chosen specifically to provide a mechanical advantage such that the force of the biasing member 20 can be overcome by any intended user, including individuals that may have compromised strength or dexterity in their hands, wrists, or fingers. The spring constant (in the case of compression spring biasing members) and necessary distance for retracting the follower (i.e. distance spring will be compressed) will be implicated as well. However the mechanical advantage of the system is such that there is likely to be sufficient mechanical advantage simply by choosing practical sizes for the lever arm and spool, as based upon the size of the box magazine housing in which they are incorporated.

Figure 5:
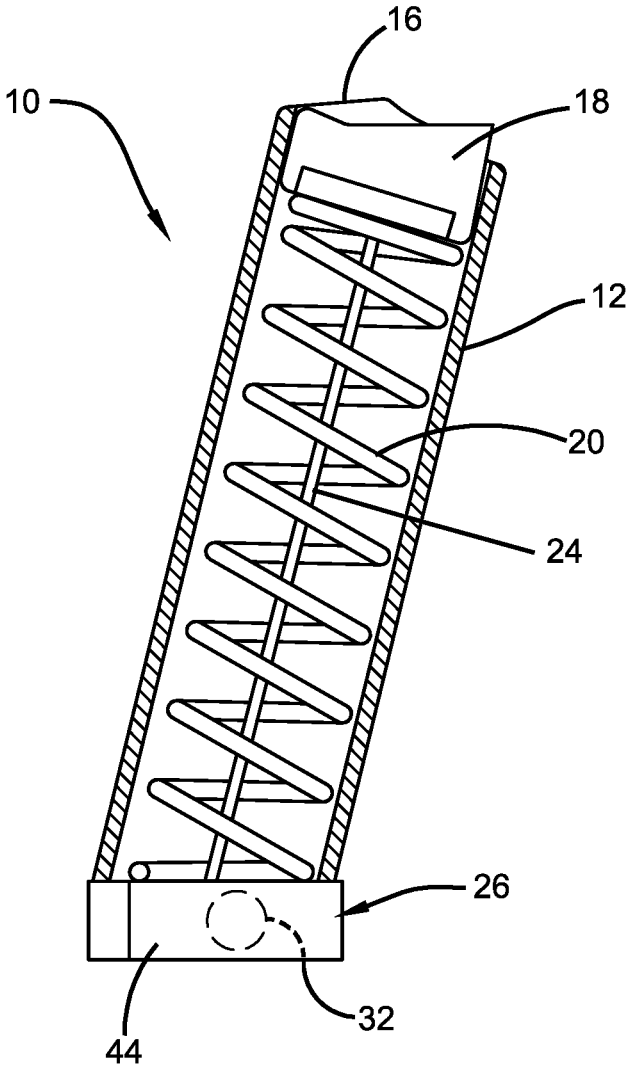
FIG. 5 is a side view, in partial cross-section, of a detachable box magazine of FIGS. 1-4, wherein the housing portion is shown in cross-section, and with a winding member in position to retract the follower.
Figure 6:
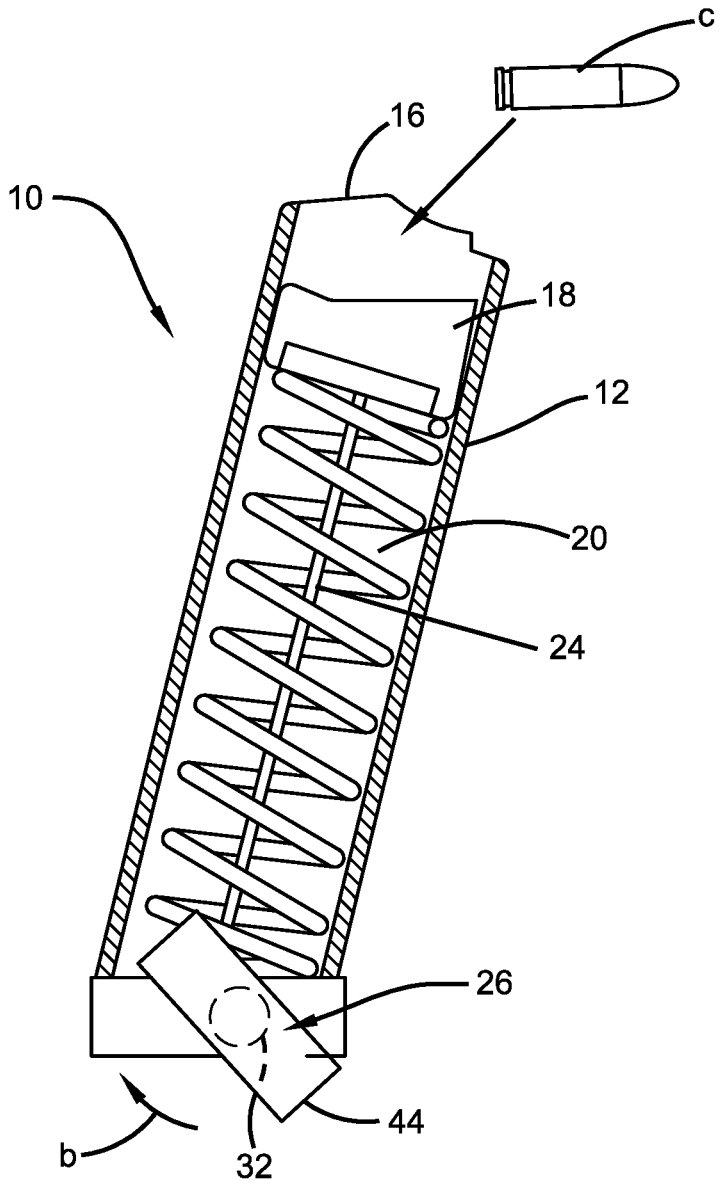
FIG. 6 is a side elevational view in partial cross-section (the housing 12 being in cross section) as in FIG. 6, showing rotation of the winding member to retract the follower.
Figure 7A:
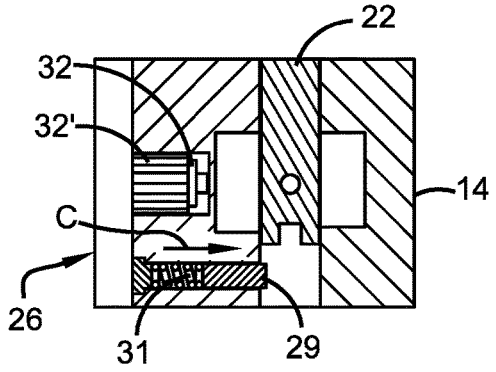
FIG. 7A is a cross-section similar to that taken in FIG. 2 but showing an alternative locking mechanism useful in the present invention.
Figure 7B:
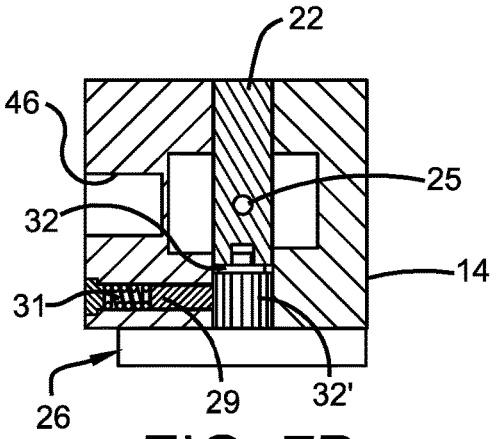
FIG. 7B is a cross-section as in FIG. 7A, showing a winding member engaging the spool member.
Figure 7C:
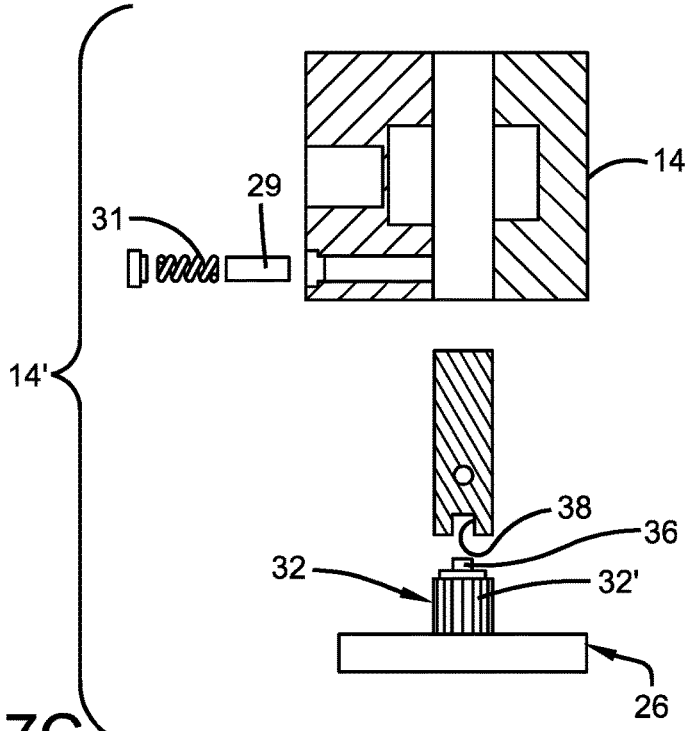
FIG. 7C is an assembly view of the embodiment of FIGS. 7A, 7B and 7D.
Figure 7D:
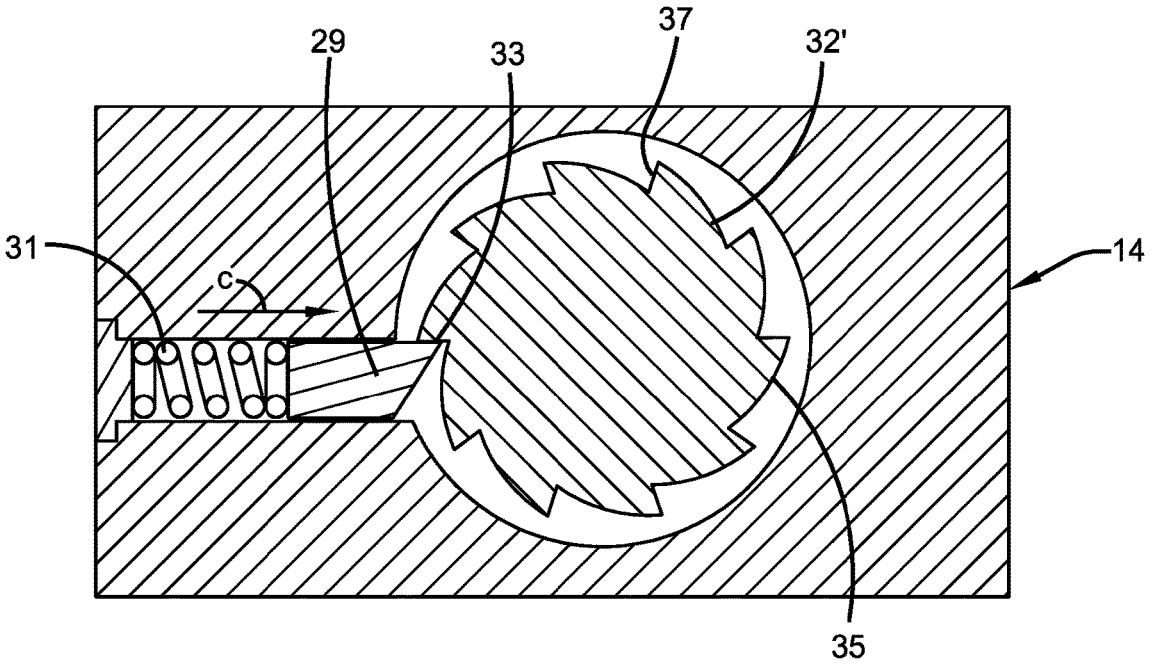
FIG. 7D is a cross section taken along the line 7D-7D in FIG. 7B.
Figure 8:
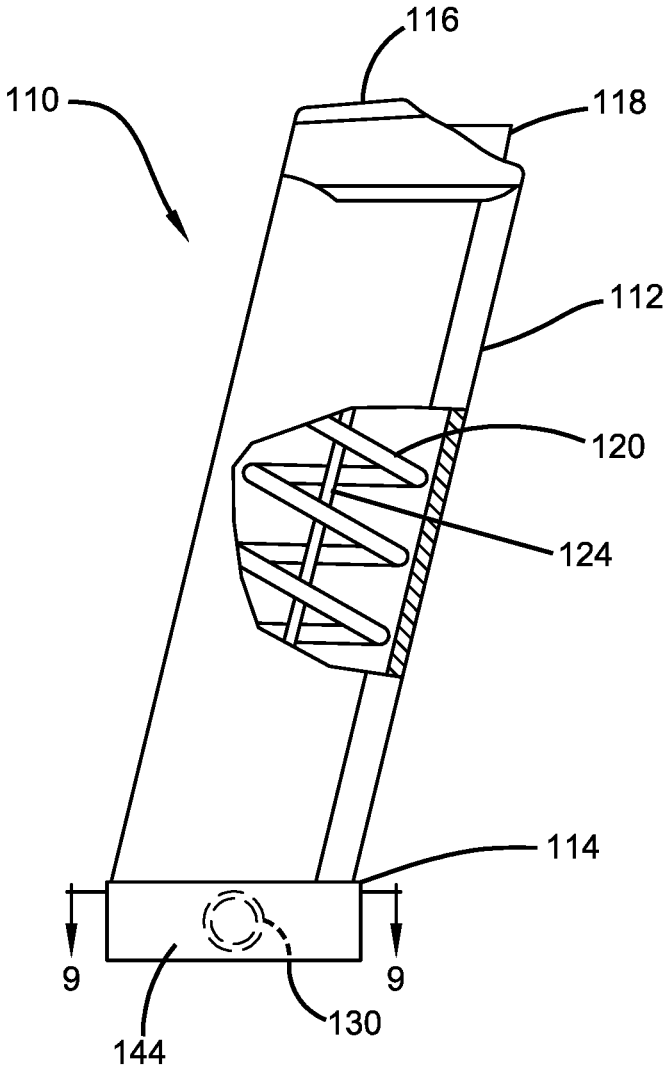
FIG. 8 is a side elevational view of a second embodiment of a detachable box magazine in accordance with this invention.
Figure 9:
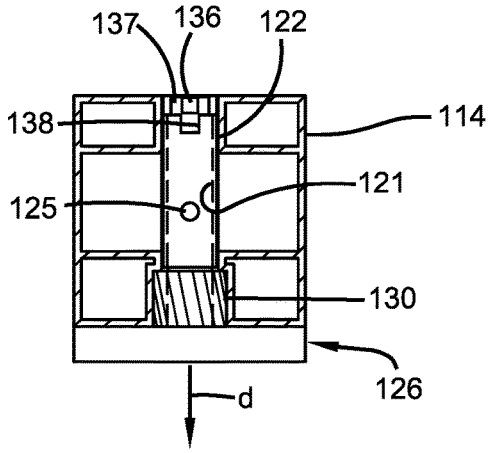
FIG. 9 is a cross-sectional view taken along the line 9-9 in FIG. 8, showing a winding member disengaged from a spool member.

Referring now to FIGS. 5 and 6, it is seen that the winding member 26 has been inserted through the locking member 28 (in this embodiment, a one-way bearing 30) so that coupling member 36 and 38 mate. More particularly, the drive shaft 32 extends through the one-way bearing 30 and is held thereby against rotation in an unwanted direction (here counterclockwise), but can be rotated in a desired direction (here clockwise) as shown in FIG. 6. Rotation in the desired direction winds the retraction member 24 about the spool member 22, thus pulling the follower 18 downwardly to permit the loading of a cartridge c between the shoulders 16 and the follower 18. The one-way bearing 30 maintains the position of the follower 18 by prohibiting counter rotation of the drive shaft 32 such that the winding member can be released and cartridges grabbed and loaded by the user.

Notably, the user can grip the magazine in one hand, manipulate the winding member with another hand to pull the follower downwardly to allow for the loading of one or more cartridges, let go of the winding member and load the cartridges, then further manipulate the winding member to pull the follower down farther and load more cartridges. This can be repeated until all desired cartridges are loaded. Thus, after loading a first cartridge, the follow can either be further retracted downwardly for more loading or the drive shaft 32 can be removed to disengage the coupling members 36, 38, thus allowing the spool member 22 to rotate in the opposite direction and permit the follower 18 to properly seat the loaded cartridges c. This all occurs in a similar manner with a ratchet embodiment of FIGS. 7A-D, where a pawl resists rotation of the drive shaft in an unwinding direction.

In the embodiment shown in FIGS. 7A through 7D, the locking member can be a pawl 29 that engages the winding member 26. More particularly, a portion of the drive shaft 32 of the winding member 26 is formed as a gear 32' that interacts with the pawl 29. In the example shown, the pawl 29 is retained in a through bore capped by a set screw, the through bore communicating with a bore receiving the gear 32' portion of the shaft 32. The pawl 29 is biased in the direction of arrow c (FIG. 7A) by a compression spring 31 or other suitable biasing member acting between the set screw and the pawl 29 such that the pawl 29 is forced to interact with the gear 32' when the winding member 26 is employed to retract the follower 18. The winding member has a first coupling member 36 for engaging a second coupling member 38 of the spool member 22, and, upon rotation of the winding member 26 in a winding direction, the pawl 29 is moved against the bias of arrow c by ramped surfaces 35 (FIG. 7D) of the gear of drive shaft 32', to allow rotation of the winding member 26, and the follower 18 is retracted. Upon release of the winding member 26, it is retained in place against movement in an unwinding direction because a stop surface 33 of the pawl 29 extends to engage the stop surfaces 37 on the gear 32'. This holds the drive shaft 32 (and hence follower 18) in position, and the winding member 26 can be released and cartridges loaded, as already disclosed. By disengaging the coupling members 36, 38, the follower is allowed to return to seat the cartridges, again as already disclosed. This is a basic ratchet mechanism, and its practice in light of the teaching herein will be evident to those of ordinary skill in the art. It can be practiced with the embodiments of FIGS. 9-16 as well.

In some embodiments, the winding member 26 is removable from engagement with the remainder of the box magazine 10 so as to be capable of being carried around. In some embodiments, such as that shown in FIGS. 1-6, the box magazine 10 includes means for storing the winding member 26 to retain it with the remainder of the box magazine 10 when not in use. In the embodiment of FIGS. 1-6, the means for storage is simply a storage bore 46 that serves to receive the drive shaft 32 of the winding member 26. The storage bore could have thread or friction elements or other well-known means for securing the winding member 26.

Figure 3:
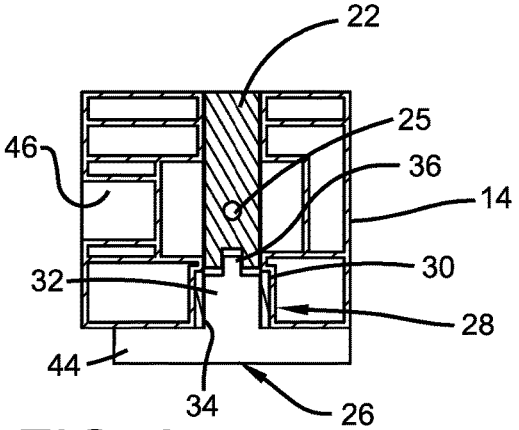
FIG. 3 is a cross-section, as in FIG. 2, showing the winding member engaging the spool member.
Figure 4:
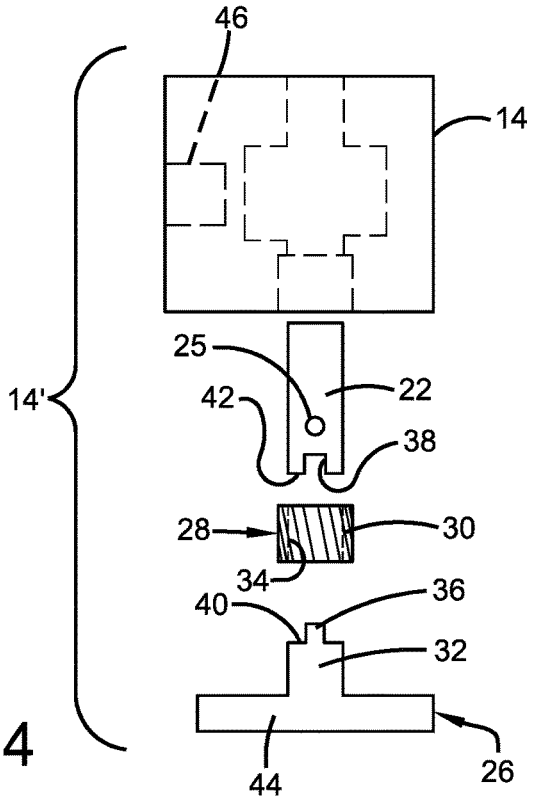
FIG. 4 is an assembly view of certain elements of FIGS. 2 and 3.

In some embodiments, the base 14 is provided as a base unit 14' (e.g., FIGS. 4 and 7C) that includes the spool member 22 and locking member 28 and winding member 26. Such a base unit 14' serves as the bottom wall of the housing 12. In some embodiments, the base unit 14' is dimensioned so as to fit substantially flush with the grip of the gun g to which the detachable box magazine 10 is mounted. In the embodiment shown, this would entail having the top of the base unit 14' sit flush with the bottom of the grip portion of the handgun g. Due consideration will be given to the type, placement, and dimensions of the winding member 26 so as to permit its rotation without interference from the housing 12 or grip portion. Here, the handle portion 44 is outside of the footprint of the housing when mounted for retracting the retraction member 24 (FIGS. 3 & 6). In some embodiments, when the magazine is mounted to a handgun or rifle, the handle portion 44 is unable to be turned due to interference with the grip portion or other portion of the handgun/rifle. As is common, the walls of the base 14 or base unit 14' might flare out slightly beyond the footprint of the grip portion to provide a better grip. Various designs can be implemented to provide an aesthetically pleasing gun without unnecessary protruding elements.

Referring now to FIGS. 8-11 a second embodiment of a detachable box magazine is shown and designated by the numeral 110. With respect to this embodiment, like parts as compared to the embodiment of FIGS. 1-7 are similarly numbered though increased by 100. In this embodiment, the winding member 126 can remain part of the box magazine 110 more permanently, and is not intended to be removable and capable of being carried or stored (as at bore 46 for winding member 26.

Thus, the detachable box magazine 110 of this embodiment has a housing 112, a base 114 opposite shoulders 116, and a follower 118 that is biased by a biasing element 120 acting between the base 114 and the follower 118. A spool member 122 is provided for retracting the follower 118 away from the shoulders 116 and providing the necessary space between the shoulders 116 and the follower 118 to allow for the loading of one or more cartridges c.

A retraction member 124 is operatively connected to the follower 118 and to the spool member 122. Upon rotation of the spool member 122, the retraction member 124 is wound about the spool member 122, and the follower 118 is pulled downwardly. A winding member 126 can be selectively engaged with the spool member 122, as seen particularly in comparison of FIGS. 9 and 10. When selectively engaged with the spool member 122, the winding member 126 can be manipulated to rotate the spool member 122 in a winding direction to wind the retraction member 124 about the spool member 122 and pull the follower 118 toward the base 114 against the biasing element 120. The retraction member 124 can be fastened by any appropriate manner to the follower 118 and the spool member 122. A hole 125 is shown in the spool member 122 for this purpose, and a wire-like retraction member 124 could be tied or otherwise secured at this hole. A similar hole and tie-off could be used at follower 118.

When the winding member 126 is selectively engaged with the spool member 122 (FIG. 10), the spool member 122 is prevented from rotating in an unwinding direction that would permit the retraction member 124 to unwind from the spool member 122 under the biasing force of biasing element 120. In particular embodiments, a locking member 128 maintains the follower 118 proximate the position to which it is pulled by the winding of the retraction member 124 about the spool member 122 in the winding direction. Additionally, disengaging the winding member 126 from engagement with the spool member 122 (FIG. 9) permits the spool member 122 to rotate in the unwinding direction under the bias of the biasing element 120 to permit the retraction member 124 to unwind from the spool member 122. In some embodiments, disengaging the winding member 126 from the spool member 122 allows the spool member 122 to freewheel so that the follower 118 can be urged toward the shoulders 116, properly seating whatever cartridges c have been loaded. In some embodiments, the locking member 128 is secured to the base 114 to as to be held stationary therein.

Figure 10:
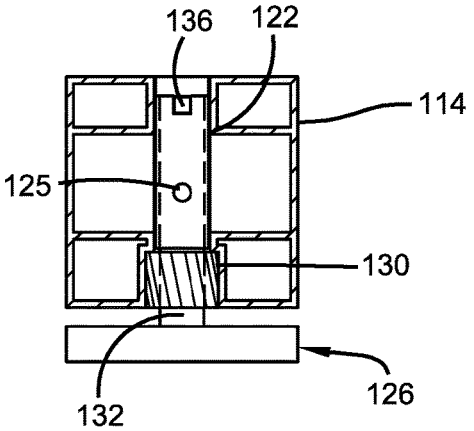
FIG. 10 is a cross-sectional view, as in FIG. 9, showing a winding member engaged with a spool member.
Figure 11:
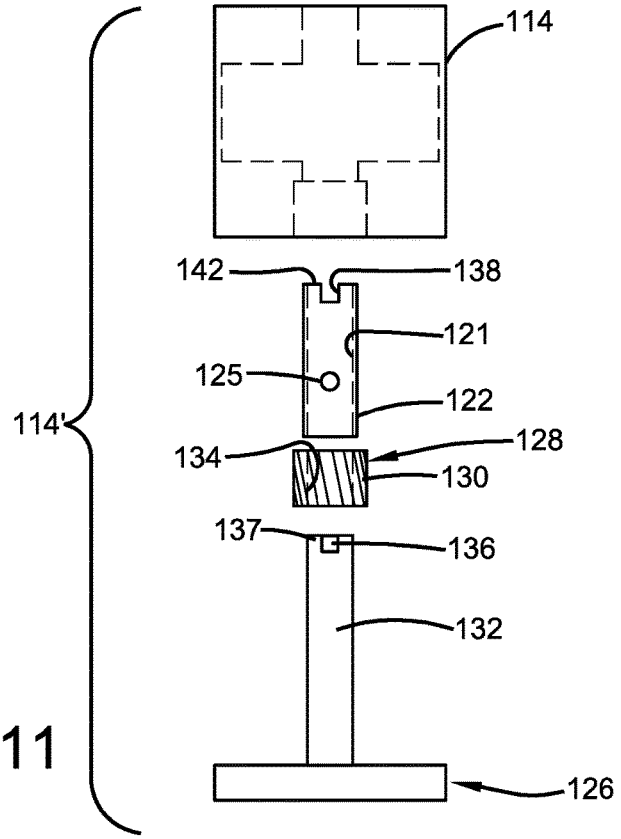
FIG. 11 is an assembly view of certain elements in FIGS. 8, 9, and 10.

With reference to FIGS. 10 and 11, it is seen that the winding member 126 has a drive shaft 132 that extends through a through bore 121 in the spool member 122, and provides a first coupling member 136 proximate a distal end 137. The distal end 142 of the spool member 122 includes a second coupling member 138. The winding member 126 has a spool-engaging position and a release position. In the spool-engaging position shown in FIG. 10, the first coupling member 136 engages the second coupling member 138, and rotation of the winding member 126 causes rotation of the spool member 122 in light of that coupling. In the release position shown in FIG. 9, the first coupling member 136 does not interact with the second coupling member 138, and the spool member 122 can rotate under the influence of the biasing element 120 acting on the follower 118 and, thus, the retraction member 124 wound about the spool member 122.

In some embodiments, the release position places the handle 144 of the winding member 126 flush with the remainder of the base 114. In some embodiments, the base 114 is provided as a base unit 114' (e.g., FIGS. 4 and 7C) that includes the spool member 122 and locking member 128 and winding member 126. Such a base unit 114' serves as the bottom wall of the housing 112. In some embodiments, the base unit 114' is dimensioned so as to fit substantially flush with the grip of the gun g to which the detachable box magazine 110 is mounted. In the embodiment shown, this would entail having the top of the base unit 114' sit flush with the bottom of the grip portion of the handgun g. Due consideration will be given to the type, placement, and dimensions of the winding member 126 so as to permit its rotation without interference from the housing 112. Here, the handle portion 144 is outside of the footprint of the housing 112 when pulled to engage the coupling members 136, 138, and this permits it to be rotated. In some embodiments, when the magazine is mounted to a handgun or rifle, the handle portion 144 is unable to be turned due to interference with the grip portion or other portion of the handgun/rifle. As is common, the base 114 or base unit 114' might flare out slightly beyond the footprint of the grip portion. Various designs can be implemented to provide an aesthetically pleasing gun without unnecessary protruding elements.

In the embodiment shown, the locking member 128 is a one-way bearing 130 and the drive shaft 132 of the winding member 126 extends through a through bore 134 in the one-way bearing 130. The one-way bearing 130 permits the drive shaft 132 to rotate in one direction (e.g., clockwise) which will serve as the winding direction, and will prevent rotation of the drive shaft 132 in an unwinding direction (e.g., counter clockwise). The pawl and gear embodiment of FIG. 7 is equally applicable to the embodiment of FIGS. 8-11 (the one-way bearing 130 being replaced with a pawl, and the drive shaft 132 at the location of the pawl being provided as a gear with stop surfaces and ramped surfaces).

The retraction and seating of cartridges would occur similarly as in FIGS. 5 and 6. The winding member 126, at handle portion 144, is first pulled out in the direction of arrow d (FIG. 9) to engage the spool member 122 (engage coupling members 136, 138). Rotation in the direction permitted by the locking mechanism 128 winds the retraction member 124 about the spool member 122 and pulls the follower 118 downwardly for loading of a cartridge c. Once a desired number of cartridges are loaded, disengaging the coupling members 136, 138 permits the spool member 122 to rotate and allows the follower 118 to move upwardly and seat the cartridges.

Figure 12:
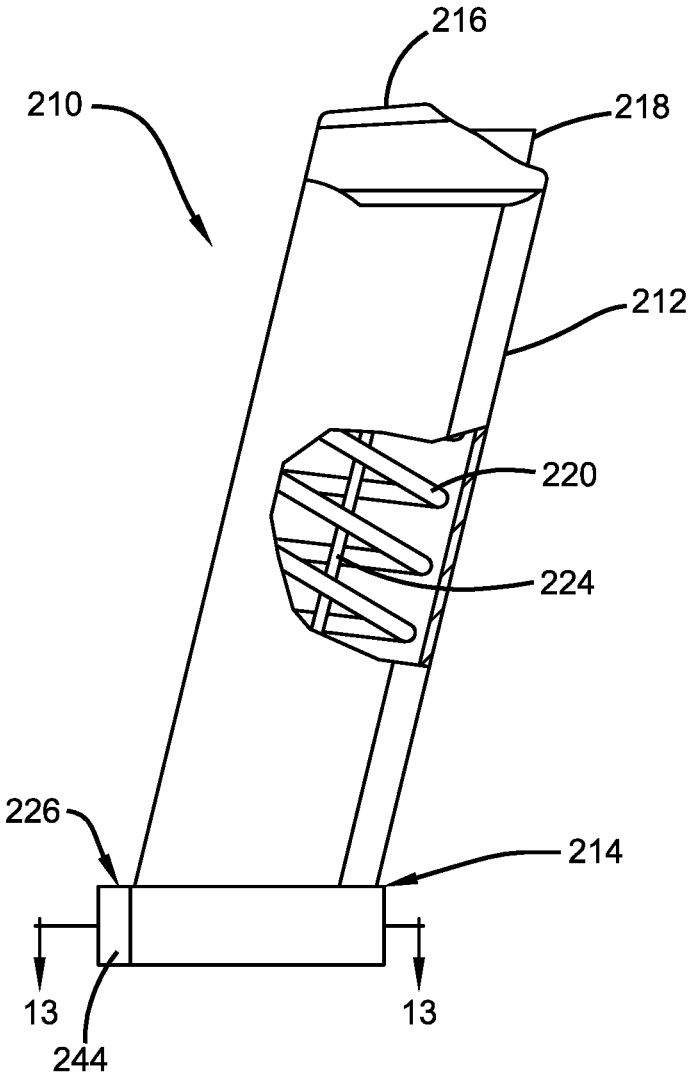
FIG. 12 is a side elevational view of a third embodiment of a detachable box magazine in accordance with this invention.
Figure 13:
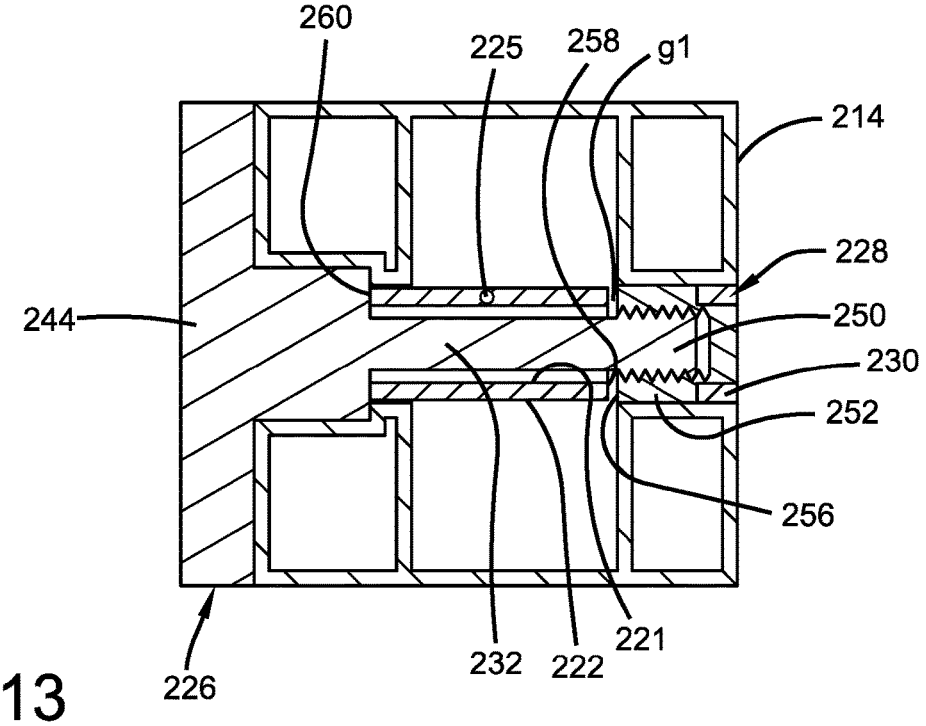
FIG. 13 is a cross-sectional view take along the line 13-13 in FIG. 12, showing the winding member disengaged from the spool member.
Figure 14:
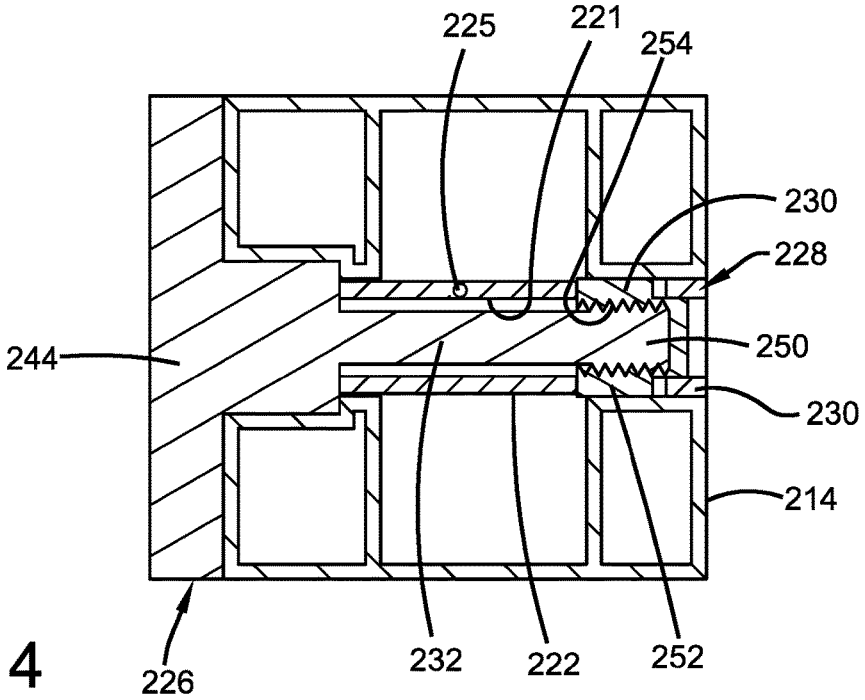
FIG. 14 is a cross-sectional view as in FIG. 13, showing the winding member engaged with the spool member.

Referring now to FIGS. 12-14 a third embodiment of a detachable box magazine is shown and designated by the numeral 210. With respect to this embodiment, like parts as compared to other embodiment of FIGS. 1-7 are similarly numbered though increased by 200, with respect to the first embodiment, and by 100 with respect to the second embodiment. In this embodiment, the winding member 226 can remain part of the box magazine 210 more permanently, and is not intended to be removable and capable of being carried or stored (as at bore 46 for winding member 26). It also does not need to be pulled out or pushed in to effect positions that engage or release the spool member (as with the embodiment of FIGS. 8-10).

The detachable box magazine 210 of this embodiment has a housing 212, a base 214 opposite shoulders 216, and a follower 218 that is biased by a biasing element 220 acting between the base 214 and the follower 218. A spool member 222 is provided for retracting the follower 218 away from the shoulders 216 and providing the necessary space between the shoulders 216 and the follower 218 to allow for the loading of one or more cartridges c.

A retraction member 224 is operatively connected to the follower 218 and to the spool member 222. Upon rotation of the spool member 222, the retraction member 224 is wound about the spool member 222, and the follower 218 is pulled downwardly. A winding member 226 can be selectively engaged with the spool member 222, as seen particularly in comparison of FIGS. 13 and 14. When selectively engaged with the spool member 222, the winding member 226 can be manipulated to rotate the spool member 222 in a winding direction to wind the retraction member 224 about the spool member 222 and pull the follower 218 toward the base 214 against the biasing element 220. The retraction member 224 can be fastened by any appropriate manner to the follower 218 and the spool member 222. A hole 225 is shown in the spool member 222 for this purpose, and a wire-like retraction member 224 could be tied or otherwise secured at this hole. A similar hole and tie-off could be used at follower 218.

When the winding member 226 is selectively engaged with the spool member 222 (FIG. 14), the spool member 222 is prevented from rotating in an unwinding direction that would permit the retraction member 224 to unwind from the spool member 222 under the biasing force of biasing element 220. In particular embodiments, a locking member 228 maintains the follower 218 proximate the position to which it is pulled by the winding of the retraction member 224 about the spool member 222 in the winding direction. Additionally, disengaging the winding member 226 from engagement with the spool member 222 (FIG. 13) permits the spool member 222 to rotate in the unwinding direction under the bias of the biasing element 220 to permit the retraction member 224 to unwind from the spool member 222. In some embodiments, disengaging the winding member 226 from the spool member 222 allows the spool member 222 to freewheel so that the follower 218 can be urged toward the shoulders 216, properly seating whatever cartridges c have been loaded. Specifics of the engagement and disengagement of the winding member 226 from the spool member 222, and the general operation of the magazine 210 are next disclosed.

Figure 15:
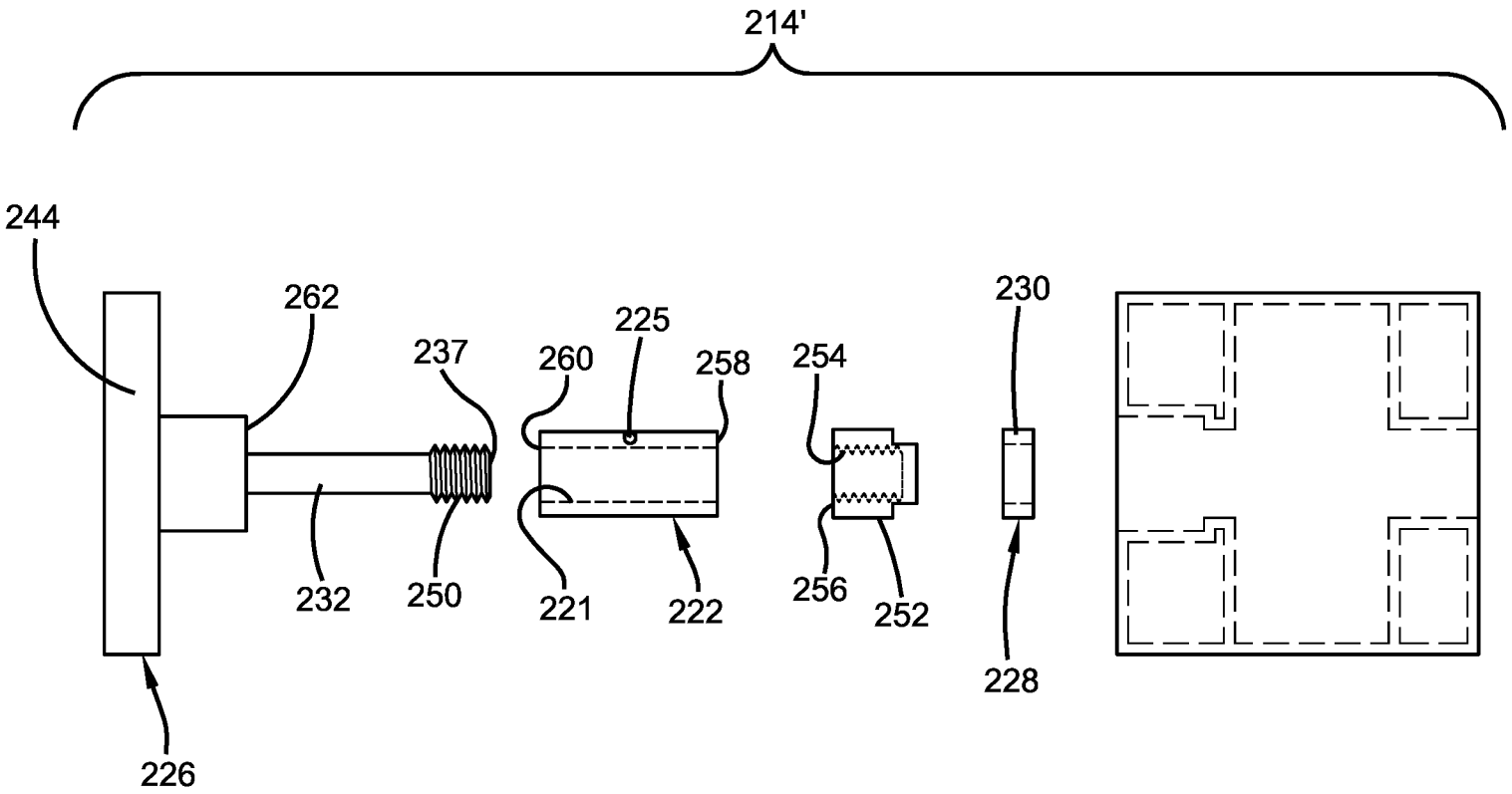
FIG. 15 is an assembly view of certain elements of FIGS. 12, 13, and 14.

With reference to FIGS. 13 and 14, it is seen that the winding member 226 has a drive shaft 232 that extends through a through bore 221 in the spool member 222 (i.e., the spool member 22 fits over the drive shaft 232), and the drive shaft 232 provides a threaded drive end 250 at a distal end 237. A drive nut 252 provides a threaded bore 254, receiving the threaded drive end 250 of the winding member 226. The drive nut 252 is held in the base 214 by a locking member 228, but can move toward and away from the spool member 222 (as seen in comparison of FIGS. 13-14). The threaded bore 254 is deep enough to allow for such movement, as apparent from the drawings and following description. The drive nut 252 moves axially relative to the axis of rotation of the drive shaft 232, but always remains interacting with the locking member 228, which allows for rotation of the drive nut 252 in one direction and prevents rotation in the opposite direction. In some embodiments, the locking member 228 is secured to the base 214 to as to be held stationary therein. In some embodiments the locking member 228 is a one-way bearing, such as shown in FIGS. 13-15 at numeral 230. In other embodiments, the locking member can be a ratchet mechanism like disclosed with respect to FIG. 7D where a pawl resists rotation of the drive nut 252 in opposite direction.

As seen in comparing FIGS. 13 and 14, the drive nut 252 has a spool-engaging position (FIG. 14) and a release position (FIG. 13). In the release position, there is a gap g1 between a friction surface 256 of the drive nut 242 and a friction surface 258 of the spool member 222. The spool member 222 has another friction surface 260 at its opposite end to engage a friction surface 262 provided by a suitable structure of the winding member 226. From the release position, the drive shaft 232 is rotated by manipulation of the handle 244 of the winding member 226, and the threaded drive end 250 pulls drive nut 242 toward spool member 222 due to the interaction of the threads of threaded drive end 250 and threaded bore 254. Typically the rotation is clockwise, as that is the common "tightening" direction for threaded members, but the threads could be formed to make this pulling of the drive nut 252 occur upon counterclockwise rotation. Upon sufficient rotation of the threaded drive end 240, the drive nut 252 will be drawn to close the gap g1 between the friction surface 256 of the drive nut 252 and a friction surface 258 of the spool member 222. It will be readily appreciated that, upon yet further rotation, the spool member 222 will become sufficiently pinched between the drive nut 252 and the friction surface 262 of the winding member 226 such that rotation of the winding member 226 causes rotation of the spool member 222 in light of this unique and selective coupling of the winding member 226 with the spool member 222. The locking member 228 allows for rotation of the drive nut 252 during this interaction of the threads, and rotation of the spool member 222 results in a retraction of the follower 218 through retraction member 224 winding around the spool member 222 as in other embodiments. Cartridges can be loaded as described in other embodiments.

By friction surfaces it is simply meant that the surfaces interact with each other upon sufficient tightening to create sufficient friction to achieve the engagement and of the spool member and effect the desired winding of the retraction member/follower. These surfaces could have interacting or interlocking texture, but flat surface such as shown will also suffice. Although specific high friction materials might be used, no such special material is required.

To achieve the release position wherein the winding member 226 is uncoupled from the spool member 222, the drive shaft 232 is rotated in the opposite direction of that used to pull the drive nut toward the spool member 222 (this will typically be counterclockwise in common threaded elements, but could be otherwise as already noted), and the locking member 228 prevents rotation of the drive nut 252 (where the locking member 228 interacts with the body of the drive nut 252, as at 264), such that the interaction of the threads of the threaded bore 254 and threaded drive end 240 push the drive nut 252 away from spool member 222. Once the friction surfaces 256 and 258 are separated, the spool member 222 can freewheel under the influence of the spring 220, and the follower 218 is released to properly seat loaded cartridges.

Notably, in this embodiment, the handle 244 does not need to be pulled out or pushed in to effect engaged and released positions. This provides a sleek design that is easier to use. In some embodiments, the handle 244 of the winding member 226 is flush with the remainder of the base 214. In some embodiments, the base 214 includes the spool member 222, the locking member 228, the winding member 226, and the drive nut 252, as a unit.

Referring now to FIGS. 17-20 a fourth embodiment of a detachable box magazine is shown and designated by the numeral 310. With respect to this embodiment, like parts as compared to the embodiment of FIGS. 12-15 are similarly numbered though increased by 100. In this embodiment, the winding member 326 can remain part of the box magazine 310 more permanently, and is not intended to be removable and capable of being carried or stored (as at bore 46 for winding member 26). It also does not need to be pulled out or pushed in to effect positions that engage or release the spool member (as with the embodiment of FIGS. 8-10). It also includes a winding mechanism that can be preassembled and installed as a unit into the base 314, though this embodiment is not limited to or by this particular advantageous feature. There are other advantages to this embodiment.

The detachable box magazine 310 of this embodiment has a housing 312, a base 314 opposite shoulders 316, and a follower 318 that is biased by a biasing element 320 acting between the base 314 and the follower 318. A spool member

322 is provided for retracting the follower 318 away from the shoulders 316 and providing the necessary space between the shoulders 316 and the follower 318 to allow for the loading of one or more cartridges c.

A retraction member 324 is operatively connected to the follower 318 and to the spool member 322. Upon rotation of the spool member 322, the retraction member 324 is wound about the spool member 322, and the follower 318 is pulled downwardly. A winding member 326 can be selectively engaged with the spool member 322, as seen particularly in comparison of FIGS. 18 and 19. When selectively engaged with the spool member 322, the winding member 326 can be manipulated to rotate the spool member 322 in a winding direction to wind the retraction member 324 about the spool member 322 and pull the follower 318 toward the base 314 against the biasing element 320. The retraction member 324 can be fastened by any appropriate manner to the follower 318 and the spool member 322. A hole 325 is shown in the spool member 322 for this purpose, and a wire-like retraction member 324 could be tied or otherwise secured at this hole. A similar hole and tie-off could be used at follower 318.

When the winding member 326 is selectively engaged with the spool member 322 (FIG. 19), the spool member 322 is prevented from rotating in an unwinding direction that would permit the retraction member 324 to unwind from the spool member 322 under the biasing force of biasing element 320. In particular embodiments, a locking member 328 maintains the follower 318 proximate the position to which it is pulled by the winding of the retraction member 324 about the spool member 322 in the winding direction. Additionally, disengaging the winding member 326 from engagement with the spool member 322 (FIG. 18) permits the spool member 322 to rotate in the unwinding direction under the bias of the biasing element 320 to permit the retraction member 324 to unwind from the spool member 322. In some embodiments, disengaging the winding member 326 from the spool member 322 allows the spool member 322 to freewheel so that the follower 318 can be urged toward the shoulders 316, properly seating whatever cartridges c have been loaded. Specifics of the engagement and disengagement of the winding member 326 from the spool member 322, and the general operation of the magazine 310 are next disclosed.

Figure 19:
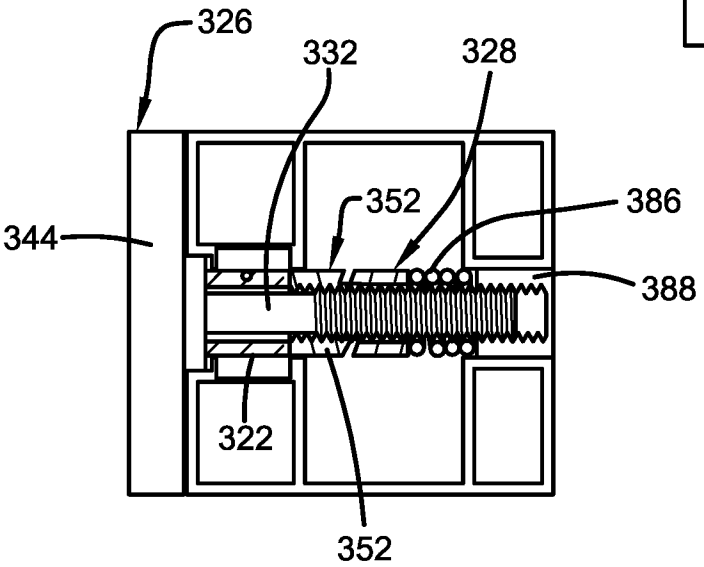
FIG. 19 is a cross-sectional view as in FIG. 18, showing the winding member engaged with the spool member.
Figure 18:
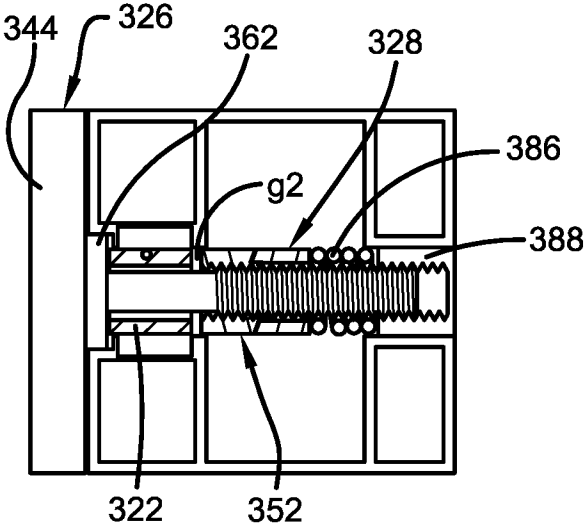
FIG. 18 is a cross-sectional view taken along the line 18-18 in FIG. 17, showing the winding the member disengaged from the spool member.
Figure 20:
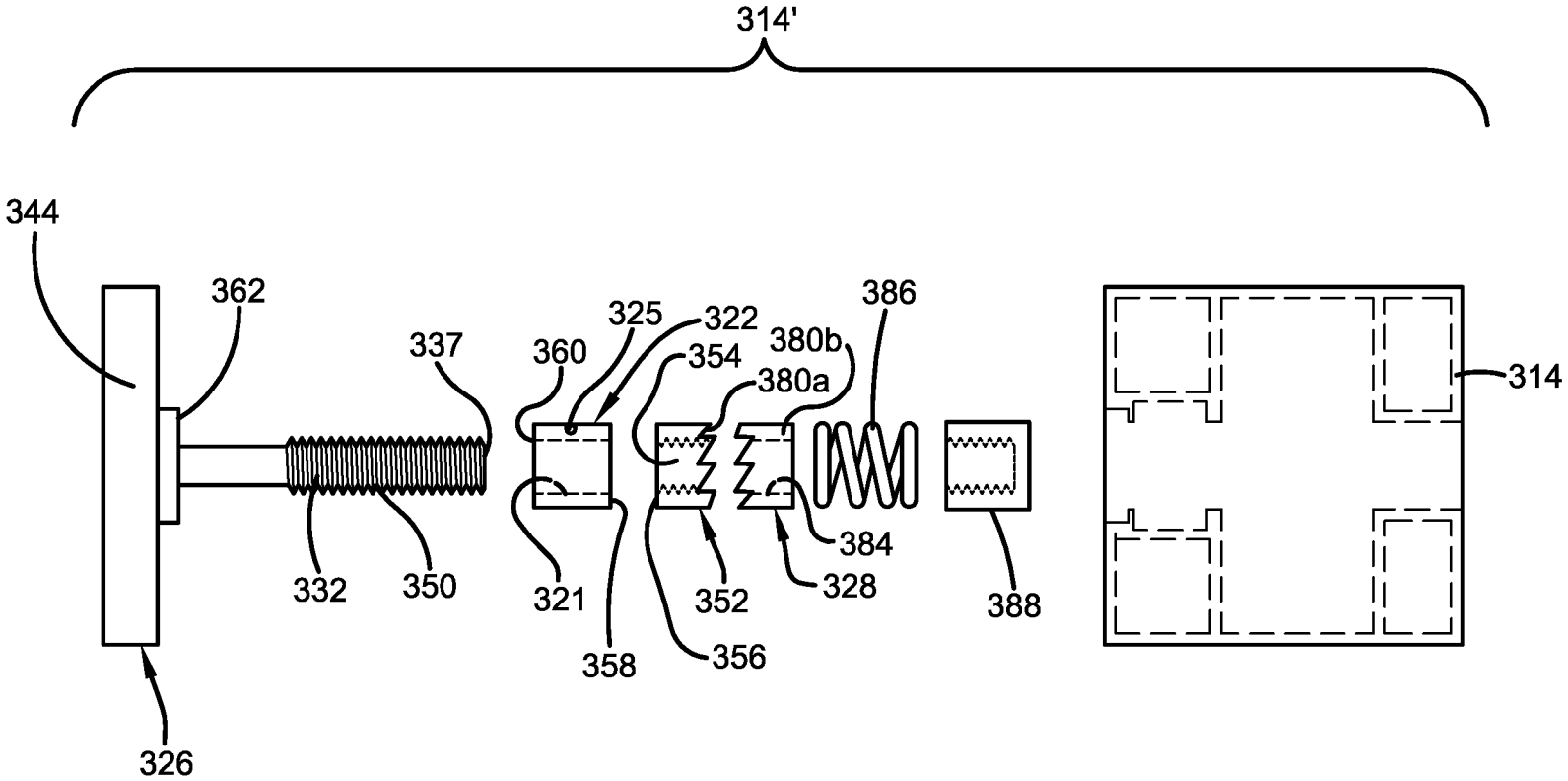
FIG. 20 is an assembly view of certain elements of FIGS. 17, 18, and 19.

With reference to FIGS. 18-20, it is seen that the winding member 326 has a drive shaft 332 that extends through a through bore 321 in the spool member 322 (i.e., the spool member 322 fits over the drive shaft 332), and the drive shaft 232 provides a threaded drive potion 350 extending to a distal end 337. A drive nut 352 provides a threaded bore 354, through which extends the threaded drive portion 350 of the winding member 326. Rotation of the drive nut 352 is regulated by the locking member 328. The drive nut 352 can move toward and away from the spool member 322 (as seen in comparison of FIGS. 18-19), with the drive nut 252 moving axially relative to the axis of rotation of the drive shaft 232, but always interacting with the locking member 328, which allows for rotation of the drive nut 352 in one direction and prevents rotation in the opposite direction. In this embodiment, the locking member 328 is secured to the base 314 so as to be held stationary therein. An appropriate set screw 378 [MLW to add to Fig] or adhesive or other means could be employed to hold the locking member 328, i.e., fix it in place.

In the specific embodiment shown, the locking member 328 and drive nut 352 interact to form a ratchet mechanism. The locking member 328 can be treated as the pawl, as it serves to prevent the rotation of the drive nut in a particular direction, while permitting its rotation in the other direction. The drive nut 352 can be considered the gear of the ratchet mechanism, as it rotates and provides the at least one gear or tooth to ratchet over at least one gear or tooth of the pawl. The rotation is indexed by means of the interacting sloped surfaces 380*a*, 380*b*, and stop surfaces 382*a*, 382*b* of the drive nut 352 and locking member 328, respectively. The drive shaft 332, and particularly its threaded drive portion 350 extends through the threaded bore 354 of the drive nut 352 as well as through a through bore 384 in the locking member 328. The distal end 337 of the threaded drive portion 350 fits into a cap 388, and a spring 386 acts against that cap 388 by being positioned between the cap 388 and the locking member 328 that is secured to be stationary in the base 314, as mentioned above. This forces the winding member 326 in the direction defined from the locking member to the cap (to the right in the example of the figures). The handle 344 is pulled toward the locking member 328. It will be appreciated that the handle 344 will move leftward and rightward slightly, defined by the depth of the interacting sloped surfaces of the drive nut 352 and locking member 328, and the spring will be loaded as the sloped surface interact, and will extend as the sloped surfaces pass each other and the drive nut 352 and locking member 328 intimately fit back together.

As seen in comparing FIGS. 18 and 19, the drive nut 352 has a spool-engaging position (FIG. 19) and a release position (FIG. 18). In the release position, there is a gap g2 between a friction surface 356 of the drive nut 342 and a friction surface 358 of the spool member 322. The spool member 322 has another friction surface 360 at its opposite end to engage a friction surface 362 provided by a suitable structure of the winding member 326. From the release position, the drive shaft 332 is rotated by manipulation of the handle 344 of the winding member 326, and the threaded drive portion 350 pulls the drive nut 342 toward spool member 322 due to the interaction of the threads of threaded drive portion 350 and the threaded bore 354, and further due to the resistance of the locking member 328. That is, until the drive nut 352 locks down on (pinches) the spool member 322, the drive nut 352 will be drawn toward the spool member 322 rather than ratcheting over the sloped surfaces 380*b* of the locking member 328. Once gap g2 is closed and the spool member 322 is pinched, the handle 344, the drive shaft 332, the spool member 322 will turn as a unit and sloped surfaces 380*a* and 380*b* will interact in a ratcheting manner. The cap 388 and spring 386 pull the winding member and associated spool member 322 and drive nut 352 toward the locking member 328 such that the drive nut 352 constantly re-seats itself intimately against the locking member 328 after sloped surfaces 380*a*, 380*b* pass each other. It will be appreciated that, while multiple sloped surfaces are shown, it is sufficient to have at least one, thought the indexed movement will be defined by a full rotation if there is only one, and each added sloped surface will shorted the indexed movement. The spool member 322 will rotate and take up the retraction member 324, and the unwinding of the retraction member 324 will be prevented by interaction of the stop surfaces 382*a*, 382*b*. Cartridges can be loaded as described in other embodiments.

To achieve the release position wherein the winding member 326 is uncoupled from the spool member 322, the drive shaft 332 is rotated in the opposite direction of that used to pull the drive nut 352 toward the spool member 322 (this will typically be counterclockwise in common threaded elements, but could be otherwise as already noted), and the locking member 328 prevents rotation of the drive nut 352 (at stop surfaces 382*a*, 382*b*), such that the interaction of the threads of the threaded bore 354 and threaded drive portion 350 push the drive nut 352 away from the spool member 322. Once the friction surfaces 356 and 358 are separated, the spool member 322 can freewheel under the influence of the spring 320, and the follower 318 is released to properly seat loaded cartridges.

Notably, in this embodiment, the winding member 326, the spool member 322, the drive nut 352, the locking member 328, the spring 386 and the cap 388 can all be assembled as a unit that is inserted into a base 314 to then have the locking member 328 set in place as already noted.

In some embodiments the locking member 328 is a one-way bearing, such as shown in FIG. 15 at numeral 230, and the replacement of the ratchet type mechanism of the drive nut 352 and the locking member 328, with a one-way bearing will be readily apparent, the drive nut 352 being received so as to move axially in the one-way bearing to close the gap g2, substantially as shown with respect to FIGS. 18 and 19, and with the drive shaft extending to a spring-loaded cap, as shown therein.

Figure 21:
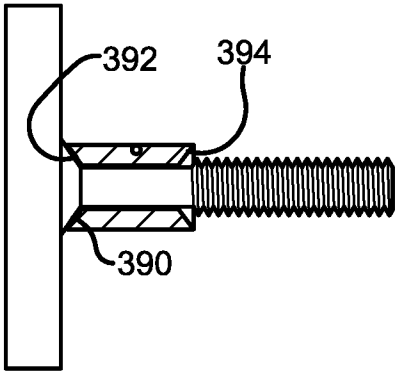
FIG. 21 is applicable to all of the embodiments of FIGS. 12-15 and 17-20, and shows the interaction of sloped surfaces to increase frictional engagement of various elements.

Friction surfaces and options therefor are defined as above, and, in this or any other embodiment, the friction surfaces can be cut or shaped to increase friction between such surfaces in the pinching occurring in the spool-engaged position. This is shown at sloped surfaces 390 and 392 and 394 in FIG. 21, and the application to embodiments shown is readily apparent.

In some embodiments, the base 314 is provided as a base unit 314' (e.g., FIG. 20) that includes the spool member 322, the locking member 328, the drive nut 352, the winding member 326, the spring 386, and the cap 388. Such a base unit 314' serves as the bottom wall of the housing 312. In some embodiments, the base unit 314' is dimensioned so as to fit substantially flush with the grip of the gun g to which the detachable box magazine 310 is mounted. In the embodiment shown, this would entail having the top of the base unit 314' sit flush with the bottom of the grip portion of the handgun g. Due consideration will be given to the type, placement, and dimensions of the winding member 326 so as to permit its rotation without interference from the housing 312 or the grip portion. Here, the handle portion 344 is outside of the footprint of the housing 312 (FIG. 12), and, thus permitted to be rotated. In some embodiments, when the magazine is mounted to a handgun or rifle, the handle portion 344 is unable to be turned due to interference with the grip portion or other portion of the handgun/rifle. As is common, the base 314 or base unit 314' might flare out slightly beyond the footprint of the grip portion. Various designs can be implemented to provide an aesthetically pleasing gun without unnecessary protruding elements.

Figure 16:
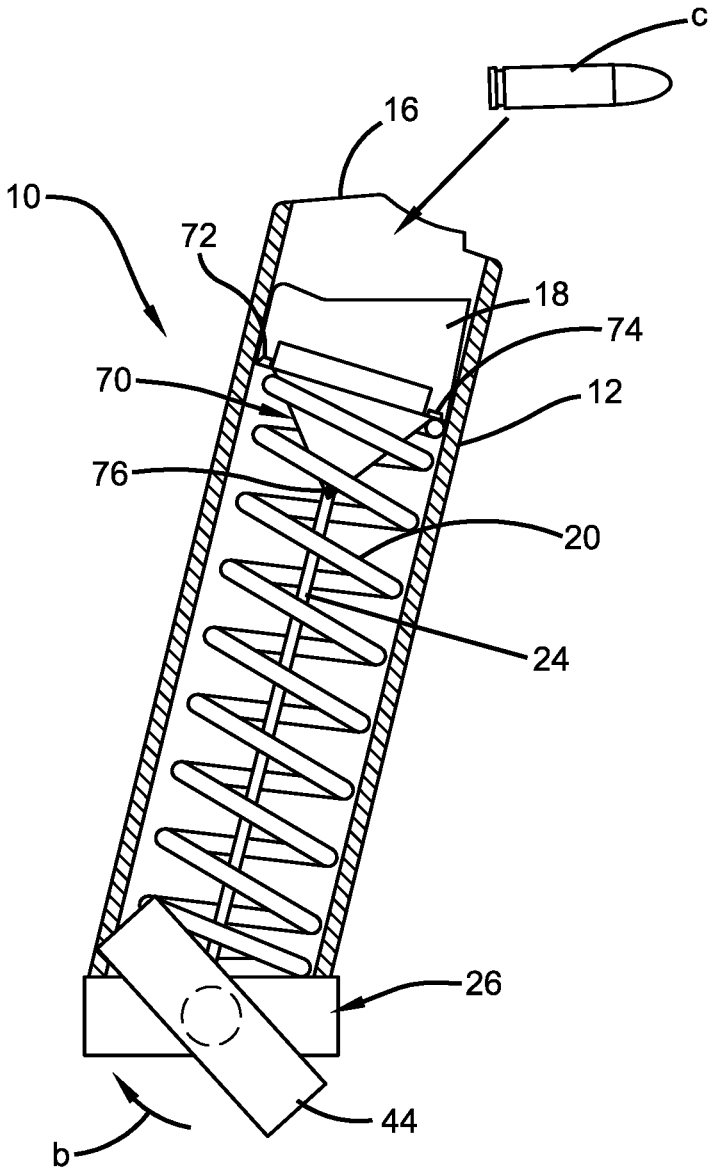
FIG. 16 shows an adaptation applicable to all embodiments and employing a force-distributing member to secure the retraction member to the follower.
Figure 17:
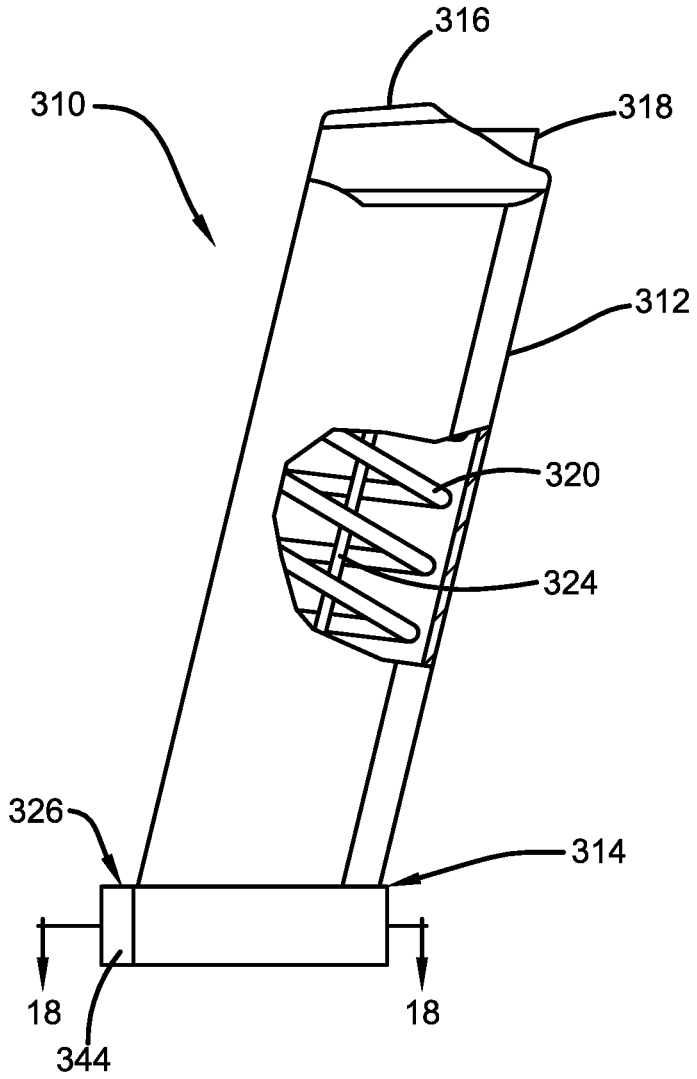
FIG. 17 is a side elevational view of a fourth embodiment of a detachable box magazine in accordance with this invention.

Referring now to FIG. 16, an adaptation applicable to all embodiments is described, though it is shown specifically using the numerals of the embodiment of FIGS. 1-6. In some embodiments, the retraction member 24 (also applicable to 124, 224, 324) is secured to the follower 18 (also applicable to 118, 218, 318) by a force-distributing member 70 that secures at least proximate the distal ends of the follower, one distal end 72 being near the primer end of loaded cartridges and the other distal end 74 being near the bullet end of the cartridge. The retraction member 24 (124, 224, 324) is secured to pull on the force-distributing member 70, which in turn will pull more evenly on the distal ends 72, 74 of the follower 18 and lessen any tendency for the follower to go out of alignment with the sidewalls of the magazine 10. In some embodiments, the force-distributing member is a triangular member, such as that shown, with the retraction member being secured at an apex 76 and the distal ends 72, 74 being defined at the base opposite that apex. In the embodiment shown, the triangular force-distributing member is in the form of a plate, but it could be a V-shaped member securing at the distal ends and to the retraction member at the apex.

It is noted that the embodiments here, by providing a mechanical advantage in retracting a follower, make it easy for anyone to load cartridges—the turning of a handle or knob to retract the follower being easier than the pressing of cartridges against each other in an effort to force the follower downwardly. Additionally, one can unload the magazines of this invention by pulling the follower downward only slightly to release the squeezing of the cartridges between the shoulders and the follower, and thereafter simply tilting the magazine to allow the cartridges to fall out under gravity. In the prior art, each individual cartridge is slid out while the follower forces the next cartridge to seat against the shoulders. A stronger spring can also be used in the present invention, again in light of the mechanical advantage provided by turning a spool member. A stronger spring can make the magazine last longer and avoid loading failure, as those of skill in the art will appreciate.

The present invention significantly advances the art by providing a detachable box magazine that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A detachable box magazine comprising:

a housing having a base;

a follower;

a biasing element biasing said follower away from said base;

a spool member;

a retraction member operatively connected to said follower and to said spool member;

a winding member selectively engaged with said spool member, and, when engaged with said spool member, manipulated to rotate said spool member in a winding direction to wind said retraction member about said spool member and pull the follower toward said base against said biasing element.

2. The detachable box magazine of claim 1, wherein said winding member is a hand-driven winding member.

3. The detachable box magazine as in claim 1, wherein, when said winding member is engaged with said spool member, said spool member is prevented from rotating in an unwinding direction that would permit said retraction member to unwind from said spool member under the bias of the biasing element.

4. The detachable box magazine as in claim 3, wherein disengaging said winding member from engagement with said spool member permits said spool member to rotate in said unwinding direction under the bias of said biasing element to permit said retraction member to unwind from said spool member.

* * * * *